US010764698B2

(12) United States Patent
Wang et al.

(10) Patent No.: US 10,764,698 B2
(45) Date of Patent: Sep. 1, 2020

(54) TERMINAL AND METHOD FOR REGULATING AND CONTROLLING VIBRATOR THEREOF

(71) Applicant: AAC Technologies Pte. Ltd., Singapore (SG)

(72) Inventors: Xiuyue Wang, Shenzhen (CN); Yulei Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/529,810

(22) Filed: Aug. 2, 2019

(65) Prior Publication Data

US 2020/0053494 A1 Feb. 13, 2020

(30) Foreign Application Priority Data

Aug. 8, 2018 (CN) ..... 2018 1 0895880

(51) Int. Cl.
*H04R 29/00* (2006.01)
*H04R 3/00* (2006.01)

(52) U.S. Cl.
CPC ..... *H04R 29/001* (2013.01); *H04R 3/00* (2013.01)

(58) Field of Classification Search
CPC ..... H04R 29/001; H04R 3/00; H04R 3/12; H04R 9/02; H04R 9/06; H04R 2400/11; H04R 2460/13
See application file for complete search history.

(56) References Cited

U.S. PATENT DOCUMENTS

2003/0067440 A1* 4/2003 Rank ..... A63F 13/5255 345/156

* cited by examiner

*Primary Examiner* — Ping Lee
(74) *Attorney, Agent, or Firm* — W&G Law Group LLP

(57) ABSTRACT

A terminal and a method for regulating and controlling a vibrator are provided. The terminal includes N speakers and N vibrators; N is a natural number greater than 1; the speakers and the vibrators are in one-to-one correspondence, for the method includes: acquiring a sound pressure value of sound played by each speaker in real time; calculating a regulation and control coefficient of vibration amplitude of the corresponding vibrator according to the sound pressure value of the speaker and a preset sound pressure limit value of the speaker; calculating a current vibration value of the corresponding vibrator according to the regulation and control coefficient and a standard vibration value of the vibrator; and controlling each vibrator to vibrate according to the corresponding current vibration value. Through the terminal and method provided, a 3D vibrating effect is achieved, and 3D tactile experience is provided for a user.

11 Claims, 6 Drawing Sheets

TERMINAL AND METHOD FOR REGULATING AND CONTROLLING VIBRATOR THEREOF

TECHNICAL FIELD

The present disclosure relates to the field of electronics technologies and, in particular, to a terminal and a method for regulating and controlling a vibrator for a terminal.

BACKGROUND

Terminals such as a cellphone, a tablet PC and the like are widely applied in people's daily life, and people have higher and higher requirements on effects generated or experience brought by various functions of the terminal, e.g., a function that a motor of the terminal drives the terminal to vibrate. Generally, one motor is mounted at an end (e.g., the bottom end) of the existing terminal, and a processor controls the motor to achieve vibration.

However, the inventor found that there are at least the following problems existed in the prior art: the existing terminal achieves vibration by one single motor, so that vibration at a local region of the terminal, where the single motor is located, is obvious, vibration at other regions of the terminal are relatively weak in sense, and the vibration sense from one end to the other end cannot be effectively transferred, and thus, a user cannot feel tactile experience brought by vibration at the other end of the terminal; moreover, strength of the vibration sense generated by the existing motor is monotonous, and user experience is bad.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present invention will be further illustrated with reference to the accompanying drawings and the embodiments.

Figure 1:
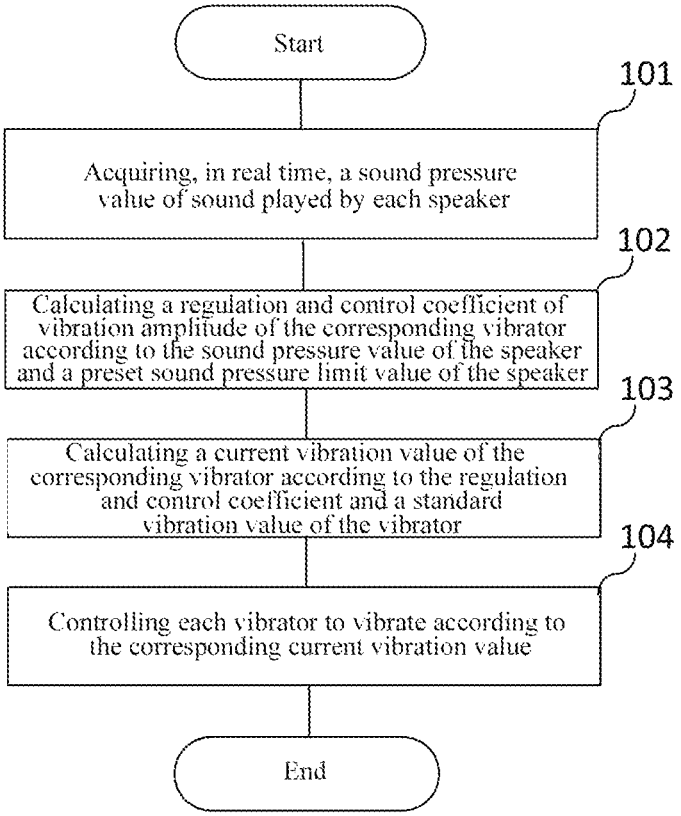
FIG. 1 is a flow schematic diagram of a method for regulating and controlling a vibrator for a terminal according to a first embodiment.

A first embodiment of the present disclosure relates to a method for regulating and controlling a vibrator for a terminal, and the terminal, for example, is a cellphone, a tablet PC and the like. As shown in FIG. 1, the method for regulating and controlling the vibrator for the terminal includes:

S101: acquiring, in real time, a sound pressure value of sound played by each speaker.

Figure 2:
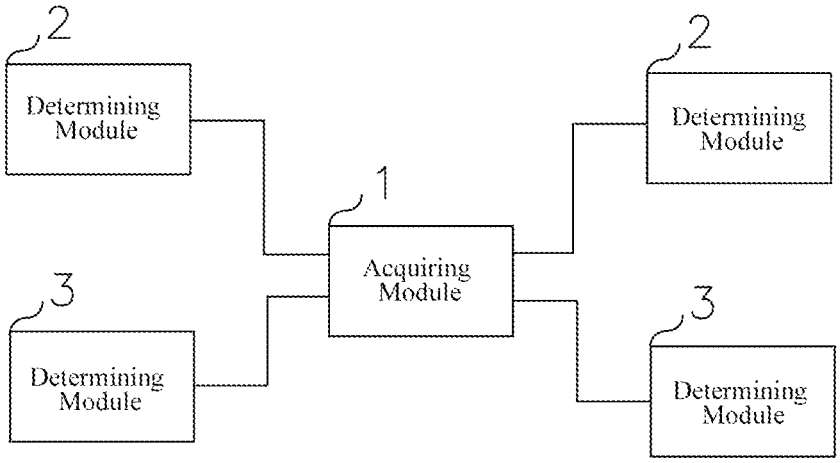
FIG. 2 is a block schematic diagram of the terminal in the method for regulating and controlling the vibrator for the terminal according to the first embodiment.

In this embodiment, (N is 2 for example), the terminal includes N speakers and N vibrators, and N is a natural number greater than 1; and the speakers and the vibrators are in one-to-one correspondence. In one example, as shown in FIG. 2, the terminal includes a processor 1, two speakers 2 and two vibrators 3, but the present disclosure does not make any limit to the value of N.

In this embodiment, a preset period can be set, the sound pressure value of the sound played by each speaker is acquired according to the preset period, the preset period is 0.2 second for example, but is not limited thereto in practice, and the present disclosure does not make any limit to the specific value of the preset period.

S102: calculating a regulation and control coefficient of vibration amplitude of the corresponding vibrator according to the sound pressure value of the speaker and a preset sound pressure limit value of the speaker.

In this embodiment, the sound pressure limit value can be set according to a limit value of a sound pressure tolerance range of human ears, but is not limited thereto, the embodiment does not make any limit to a setting mode of the sound pressure limit value. For example, the sound pressure limit value also can be set according to a limit value of a music sound pressure.

S103: calculating a current vibration value of the corresponding vibrator according to the regulation and control coefficient and a standard vibration value of the vibrator.

In this embodiment, the standard vibration value of the vibrator is an original vibration value of the vibrator, the standard vibration value can be well set before delivery and can also be manually set by a user and pre-stored in a memory, and the present disclosure does not make any limit to the setting mode of the standard vibration value.

In one example, the standard vibration value of each vibrator can be the same, but is not limited thereto in practice, the present disclosure does not make any limit to the standard vibration value of each vibrator, and the standard vibration value of each vibrator can also be different from one another.

S104: controlling each vibrator to vibrate according to the corresponding current vibration value.

According to the embodiments of the present disclosure, compared to the prior art, the terminal includes N speakers and N vibrators, and the speakers and the vibrators are in one-to-one correspondence (N is a natural number greater than 1). That is, in the method for regulating and controlling the vibrator for the terminal, as provided by the embodiments of the present disclosure, the sound pressure value of the sound played by each speaker is acquired in real time, the regulation and control coefficient of the vibration amplitude of the corresponding vibrator is calculated according to the sound pressure value of the speaker and the preset sound pressure limit value of the speaker, the current vibration value of the corresponding vibrator is calculated according to the regulation and control coefficient and the standard vibration value of the vibrator, and each vibrator is controlled to vibrate according to the corresponding current vibration value, so that vibration can be respectively achieved in regions at two ends of the terminal and each vibrator can vibrate according to a sound pressure of the corresponding speaker, thereby achieving the 3D vibrating effect and providing the 3D tactile experience for a user, which replaces a fixed and monotonous vibrating effect generated by one single vibrator and limited local region vibration achieved by one single vibrator in the prior art.

Implementation details of the method for regulating and controlling the vibrator for the terminal according to this embodiment will be specifically illustrated below, and the following contents are merely implementation details provided for facilitating understanding, rather than necessities of the solution.

In one example, the preset sound pressure limit value of each speaker is the same; in this embodiment, the sound pressure limit value of each speaker is the same, so that the regulation and control coefficient of each speaker is comparable. It is appreciated that, the above are only exemplary illustration, the present disclosure is not limited thereto in practice, and the preset sound pressure limit value of each speaker also can be different from one another.

Step partitioning in various methods above are merely intended for a clear description, and in the implementation process, the steps can be merged into one step or some steps can be divided into a plurality of sub-steps, as long as the same logic relationship is included, all of which shall fall within the protection scope of the present disclosure. Insignificant modifications or insignificant designs in an algorithm or process flow without changing the core design of the algorithm and the process flow of the present disclosure shall all fall within the protection scope of the present disclosure.

A second embodiment of the present disclosure relates to a method for regulating and controlling a vibrator for a terminal. The second embodiment is an improvement on the basis of the first embodiment, and the main improvement is that: in the second embodiment of the present disclosure, an acquiring mode of the sound pressure value is provided.

Figure 3:
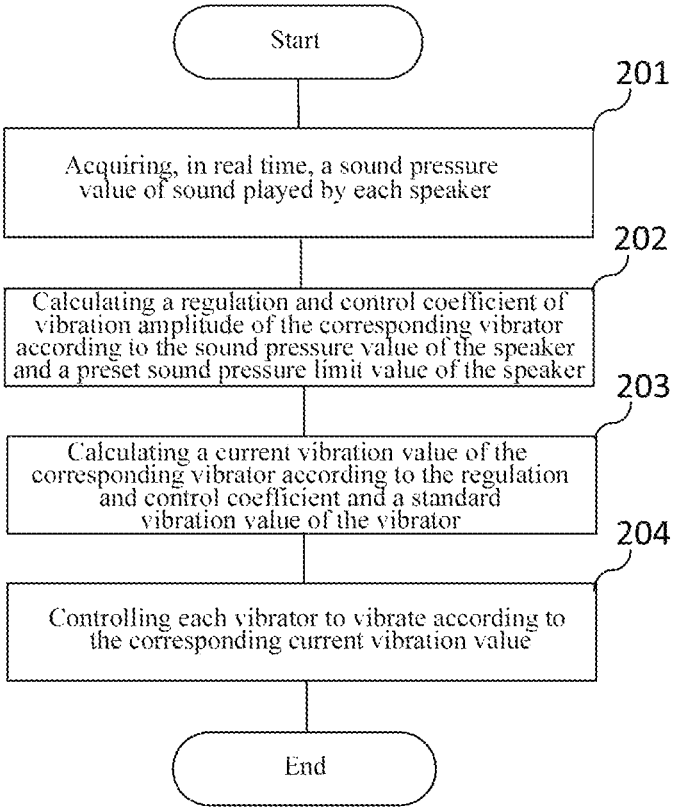
FIG. 3 is a flow schematic diagram of a method for regulating and controlling a vibrator for a terminal according to a second embodiment.

The method for regulating and controlling the vibrator according to this embodiment is as shown in FIG. 3, the steps S202 to S205 in this embodiment are the same as the steps S101 to S104 in the first embodiment and are not repeated herein, the step S201 of this embodiment includes:

S201: acquiring, by each sensor in real time, the sound pressure value of the sound played by the corresponding speaker.

Figure 4:
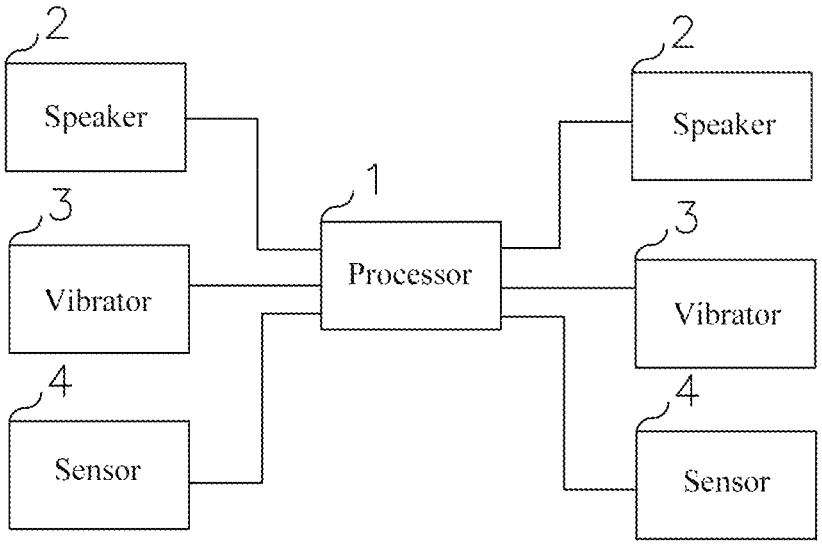
FIG. 4 is a block schematic diagram of the terminal in the method for regulating and controlling the vibrator for the terminal according to the second embodiment.

In this embodiment, as shown in FIG. 4 (N is 2 for example), the terminal further includes N sensors, and the speakers and the sensors are in one-to-one correspondence.

In this embodiment, the sensor can be a sound pressure sensor or a sound sensor, the present disclosure does not make any limit to the type of the sensor, and any type of sensor which can acquire the sound pressure value of the sound played by the speaker can be applied to this embodiment.

Figure 5:
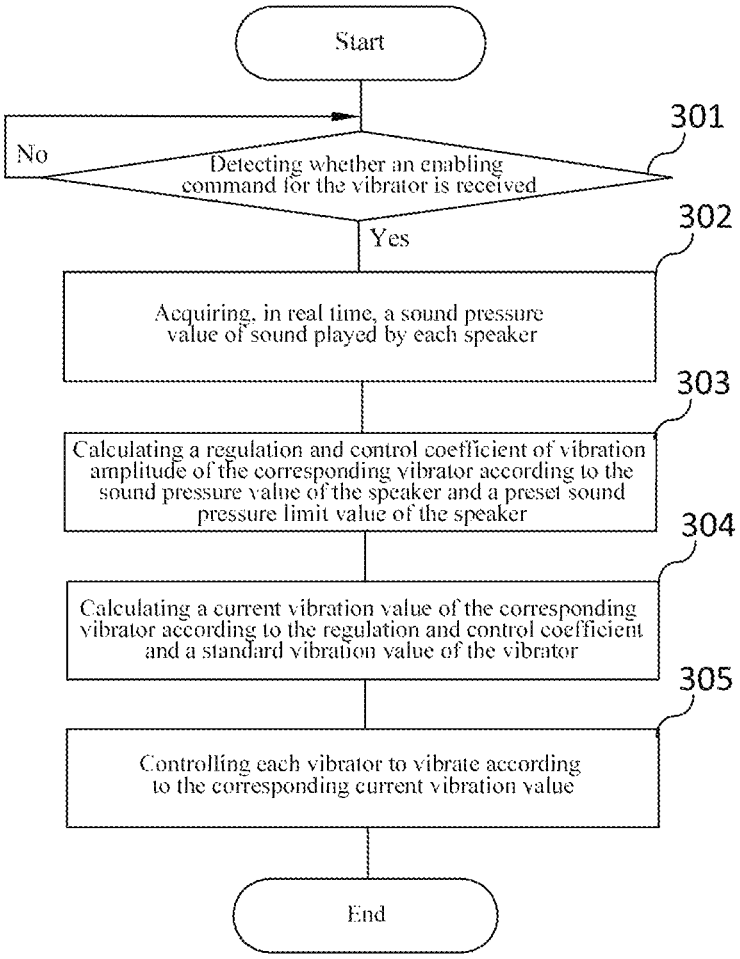
FIG. 5 is another flow schematic diagram of the method for regulating and controlling the vibrator for the terminal according to the second embodiment.

Preferably, in one embodiment, as shown in FIG. 5, the steps S302 to S305 in this embodiment are the same as the steps S201 to S204 in the second embodiment and are not repeated herein, and the following steps are included in this embodiment:

S301: detecting whether an enabling command for the vibrator is received; and if yes, executing the step S302, otherwise continuing repeating step S301.

In this embodiment, a user can select whether to open a vibrating function of the terminal as required; and when the user selects to open the vibrating function of the terminal, the terminal can receive the enabling command for the vibrator.

In one example, a user is transversely holding a cellphone to play a game of Playerunknown's Battlegrounds (the vibrators are respectively mounted at the top end and at the bottom end of the cellphone) and the vibrating function is enabled to trigger the enabling command for the vibrator, after the enabling command is detected, with shot sound on the left side in the game, the vibrator located on the left side (i.e., at the top end) vibrates along with a sound pressure of the shot sound, and with shot sound on the right side, the vibrator located on the right side vibrates along with a sound pressure of the shot sound, so as to give a good orientation prompt to the user. It is appreciated that, the above are just exemplary illustrations herein, and the present disclosure is not limited thereto in practice.

In this preferred embodiment, detection of an enabling command for the vibrator is prior to acquiring the sound pressure value, so that energy consumption can be saved.

In practice, the embodiment as shown in FIG. 5 can also be an improved solution on the basis of the first embodiment.

This embodiment, compared to the first embodiment, provides an acquiring mode of the sound pressure value, i.e., the mode of acquiring, by each sensor in real time, the sound pressure value of the sound played by the corresponding speaker.

A third embodiment of the present disclosure relates to a method for regulating and controlling a vibrator for a terminal. The third embodiment is an improvement on the basis of the second embodiment, and the main improvement is that: in the third embodiment of the present disclosure, a specific calculating mode of the regulation and control coefficient and the current vibration value is provided.

Figure 6:
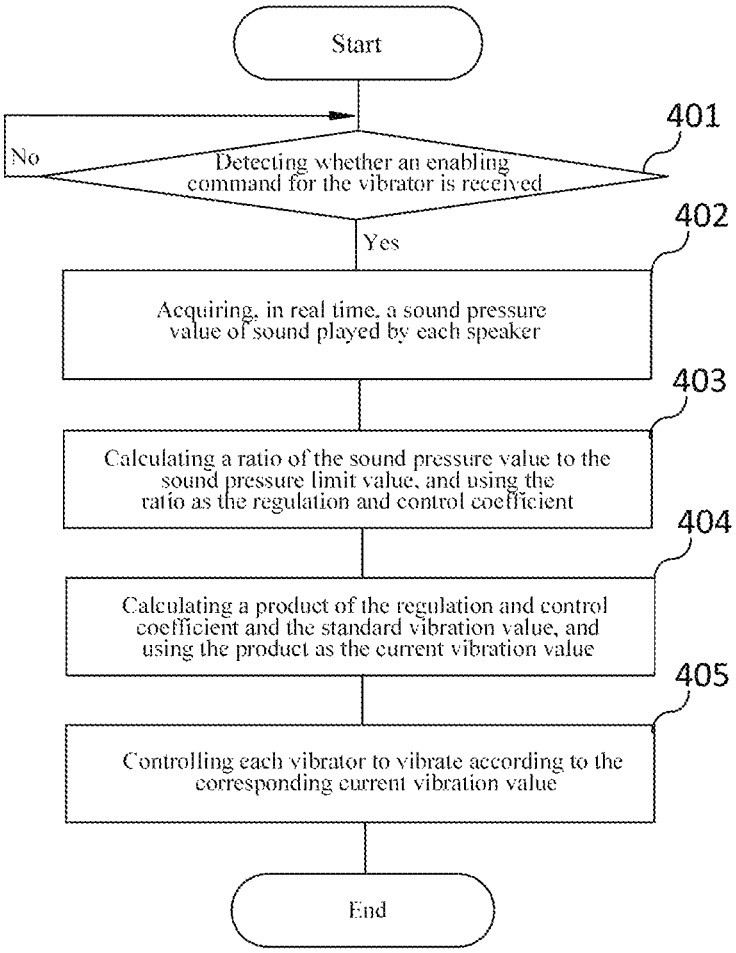
FIG. 6 is a flow schematic diagram of a method for regulating and controlling a vibrator for a terminal according to a third embodiment.

The method for regulating and controlling the vibrator according to the this embodiment is as shown in FIG. 6, the steps S401, S402 and S405 in this embodiment are the same as the steps S301, S302 and S305 in the second embodiment and are not repeated herein, and the step S403 and the step S404 in this embodiment are as follows:

S403: calculating a ratio of the sound pressure value to the sound pressure limit value, and using the ratio as the regulation and control coefficient.

In one example, the sound pressure value is A1, the sound pressure limit value is A0, the ratio of the sound pressure value to the sound pressure value is A1/A0=1. It is appreciated that, the above are just exemplary illustrations herein and the present disclosure is not limited thereto in practice.

S404: calculating a product of the regulation and control coefficient and the standard vibration value, and using the product as the current vibration value.

In one example, the regulation and control coefficient is I, the pre-stored standard vibration value is V0, then the current vibration value is V1=I*V0. It is appreciated that, the above are just exemplary illustrations and the present disclosure is not limited thereto in practice.

In practice, this embodiment also can be an improvement on the basis of the first embodiment.

The embodiment of the present disclosure, compared to the second embodiment, provides a specific calculating mode of the regulation and control coefficient and the current vibration value, i.e., a mode of using the ratio of the sound pressure value to the sound pressure limit value as the regulation and control coefficient and using the product of the regulation and control coefficient and the standard vibration value as the current vibration value.

A fourth embodiment of the present disclosure relates to a terminal. With reference to FIG. 2, the terminal includes: a processor, a memory, N speakers and N vibrators; N is a natural number greater than 1; the speakers and the vibrators are in one-to-one correspondence. The processor is connected to the memory, each speaker and each vibrator. The memory stores an instruction which can be executed by the processor, and when the instruction is executed by the processor, the processor can execute the method for regulating and controlling the vibrator for the terminal according to any one of the first embodiment and the third embodiment.

According to the embodiments of the present disclosure, compared to the prior art, the terminal includes N speakers and N vibrators, and the speakers and the vibrators are in one-to-one correspondence (N is a natural number greater than 1). That is, in the terminal as provided by the embodiments of the present disclosure, the processor can acquire the sound pressure value of the sound played by each speaker in real time, calculate the regulation and control coefficient of the vibration amplitude of the corresponding vibrator according to the sound pressure value of the speaker and the preset sound pressure limit value of the speaker, calculate the current vibration value of the corresponding vibrator according to the regulation and control coefficient and the standard vibration value of the vibrator, and control each vibrator to vibrate according to the corresponding current vibration value, so that vibration can be respectively achieved in regions at two ends of the terminal and each vibrator can vibrate according to a sound pressure of the corresponding speaker, thereby achieving the 3D vibrating effect and providing the 3D tactile experience for the user, which replaces a fixed and monotonous vibrating effect generated by one single vibrator and limited local region vibration achieved by one single vibrator in the prior art.

Implementation details of the terminal according to this embodiment will be specifically illustrated below, and the following contents are merely implementation details provided for facilitating understanding, rather than necessities of the solution.

In this embodiment, with reference to FIG. 4, the terminal further includes N sensors connected to the processor; the sensors and the speakers are in one-to-one correspondence. Each sensor is configured to acquire the sound pressure value of the sound played by the corresponding speaker, and the processor can execute the method for regulating and controlling the vibrator for the terminal according to the second embodiment.

In this embodiment, the sensor can be a sound pressure sensor or a sound sensor, the present disclosure does not make any limit to the type of the sensor, and any type of sensor which can acquire the sound pressure value of the sound played by the speaker can be applied to this embodiment.

In one example, there are two vibrators, one vibrator is mounted at the top of the terminal, and the other vibrator is mounted at the bottom of the terminal. It is appreciated that, the above are only exemplary illustrations herein, and the present disclosure does not make any limit to the number and mounting positions of the vibrators.

Preferably, in this embodiment, each vibrator is respectively arranged at a different position of the terminal, e.g., at opposite positions, but the present disclosure does not make any limit to the distribution positions of the vibrators.

The memory is connected with the processor in a bus mode, there may be random numbers of buses and bridges which are interconnected, and the buses connect various circuits of one or more processors and memories together. The buses also can connect various other circuits such as a peripheral device, a voltage stabilizer, a power management circuit and the like together, which are all well-known in the art and thus will not be further described herein. A bus interface provides an interface between the bus and a transceiver. The transceiver can be a component, and can also be formed by a plurality of components such as a plurality of receivers and transmitters, and provides elements for communicating with various other apparatuses by a transmission medium. Data processed by the processor is transmitted on a wireless medium by an antenna, and further, the antenna also receives the data and transmits the data to the processor.

The processor takes charge of managing bus and carrying out general processing and can also provide various functions including timing, a peripheral interface, voltage regulation, power supply management and other control functions. The memory can be used for storing data used when the processor executes operations.

A fifth embodiment of the present disclosure relates to a computer readable storage medium which stores a computer program. When the computer program is executed by the processor, the method for regulating and controlling the vibrator for the terminal according to any one of the first embodiment to the third embodiment is achieved.

According to the embodiments of the present disclosure, compared to the prior art, the terminal includes N speakers and N vibrators, and the speakers and the vibrators are in one-to-one correspondence (N is a natural number greater than 1). That is, in the method for regulating and controlling the vibrator for the terminal, as provided by the embodiments of the present disclosure, the sound pressure value of the sound played by each speaker is acquired in real time, the regulation and control coefficient of the vibration amplitude of the corresponding vibrator is calculated according to the sound pressure value of the speaker and the preset sound pressure limit value of the speaker, the current vibration value of the corresponding vibrator is calculated according to the regulation and control coefficient and the standard vibration value of the vibrator, and each vibrator is controlled to vibrate according to the corresponding current vibration value, so that vibration can be respectively achieved in regions at two ends of the terminal and each vibrator can vibrate according to a sound pressure of the corresponding speaker, thereby achieving the 3D vibrating effect and providing the 3D tactile experience for a user, which replaces a fixed and monotonous vibrating effect generated by one single vibrator and limited local region vibration achieved by one single vibrator in the prior art.

Those skilled in the art can understand that implementation of all or part of the steps in the method according to the above-mentioned embodiments can be completed by instructing related hardware through the program, and the program is stored in one storage medium and includes a plurality of instructions for enabling one device (which can be a single-chip microcomputer, a chip and the like) or the processor to execute all or part of the steps in the method according to each of the embodiments of the present disclosure. The above-mentioned storage medium includes various media which can store programming codes, such as a U disk, a mobile hard disk, a Read-Only Memory (ROM), a Random Access Memory (RAM), a magnetic disk or an optical disk and the like.

Those skilled in the art should understand that the foregoing embodiments are specific embodiments for implementing the present disclosure, and in the practical application, various changes can be made thereto in form and in detail without departing from the spirit and the scope of the present disclosure.

What is claimed is:

1. A method for regulating and controlling a vibrator for a terminal, the terminal comprising N speakers and N vibrators being in one-to-one correspondence, where N is a natural number greater than 1, wherein the method comprises:

acquiring, in real time, a sound pressure value of sound played by each of the N speakers;

calculating a regulation and control coefficient of vibration amplitude of one of the N vibrators according to the sound pressure value and a preset sound pressure limit value of a corresponding one of the N speakers;

calculating a current vibration value of one of the N vibrators according to the regulation and control coefficient and a standard vibration value of the one of the N vibrators; and controlling each of the N vibrators to vibrate according to the current vibration value.

2. The method as described in claim 1, wherein the terminal further comprises N sensors, the N speakers and the N sensors being in one-to-one correspondence, and the acquiring, in real time, the sound pressure value of sound played by each of the N speakers comprises:

acquiring, by each of the N sensors in real time, the sound pressure value of sound played by a corresponding one of the N speakers.

3. The method as described in claim 1, wherein the calculating the regulation and control coefficient of vibration amplitude of one of the N vibrators according to the sound pressure value and the preset sound pressure limit value of a corresponding one of the N speakers comprises:

calculating a ratio of the sound pressure value to the sound pressure limit value as the regulation and control coefficient; and wherein the calculating the current vibration value of one of the N vibrators according to the regulation and control coefficient and a standard vibration value of the one of the N vibrators comprises:

calculating a product of the regulation and control coefficient and the standard vibration value as the current vibration value.

4. The method as described in claim 1, further comprising, prior to the acquiring, in real time, the sound pressure value of sound played by each of the N speakers:

detecting an enabling command for each of the N vibrators.

5. The method as described in claim 1, wherein the preset sound pressure limit value of each of the N speakers is identical.

6. A terminal, comprising:

a processor;

a memory;

N speakers; and

N vibrators, where N is a natural number greater than 1;

wherein the N speakers and the N vibrators are in one-to-one correspondence, the processor is connected to the memory, each of the N speakers and each of the N vibrators, and the memory stores an instruction executable by the processor, and the instruction is executed by the processor to cause the processor to perform the method as described in claim 1.

7. The terminal as described in claim 6, wherein the calculating the regulation and control coefficient of vibration amplitude of one of the N vibrators according to the sound pressure value and the preset sound pressure limit value of a corresponding one of the N speakers comprises:

calculating a ratio of the sound pressure value to the sound pressure limit value as the regulation and control coefficient; and wherein the calculating the current vibration value of one of the N vibrators according to the regulation and control coefficient and a standard vibration value of the one of the N vibrators comprises:

calculating a product of the regulation and control coefficient and the standard vibration value as the current vibration value.

8. The terminal as described in claim 6, wherein the preset sound pressure limit value of each of the N speakers is identical.

9. The terminal as described in claim 6, further comprising:

N sensors connected to the processor, wherein the N sensors and the N speakers are in one-to-one correspondence;

each of the N sensors is configured to acquire the sound pressure value of sound played by a corresponding one of the N speakers; and the processor can perform the method as described in claim 2.

10. The terminal as described in claim 6, wherein two vibrators are provided; and one vibrator is mounted at the top of the terminal, and the other vibrator is mounted at the bottom of the terminal.

11. A computer readable storage medium, storing a computer program, wherein the computer program is executed by a processor to perform the method as described in claim 1.

* * * * *